US010335697B2

(12) United States Patent
Villano et al.

(10) Patent No.: US 10,335,697 B2
(45) Date of Patent: Jul. 2, 2019

(54) COMBINATION TOY PROJECTOR AND NIGHTLIGHT

(71) Applicant: SKIP HOP, INC., New York, NY (US)

(72) Inventors: Janet Villano, Jersey City, NJ (US); Chelsea Carter, Jersey City, NJ (US); Peter Therrien, Brooklyn, NY (US); Ellen Diamant, New York, NY (US)

(73) Assignee: SKIP HOP, INC., New York, NY (US)

( * ) Notice: Subject to any disclaimer, the term of this patent is extended or adjusted under 35 U.S.C. 154(b) by 0 days.

(21) Appl. No.: 15/290,419

(22) Filed: Oct. 11, 2016

(65) Prior Publication Data

US 2018/0099226 A1 Apr. 12, 2018

(51) Int. Cl.

| | |
|---|---|
| ***A63H 3/00*** | (2006.01) |
| ***A63H 3/02*** | (2006.01) |
| ***A63H 3/28*** | (2006.01) |
| ***A63H 33/22*** | (2006.01) |
| ***A63H 33/26*** | (2006.01) |
| ***F21V 1/14*** | (2006.01) |

(52) U.S. Cl.

CPC ..... *A63H 3/003* (2013.01); *A63H 3/006* (2013.01); *A63H 3/02* (2013.01); *A63H 3/28* (2013.01); *A63H 33/22* (2013.01); *A63H 33/26* (2013.01); *F21V 1/146* (2013.01)

(58) Field of Classification Search

CPC ..... A63H 3/003; A63H 3/006; A63H 3/02; A63H 3/28; A63H 33/22; A63H 33/26

USPC ..... 446/72, 219, 227, 485

See application file for complete search history.

(56) References Cited

U.S. PATENT DOCUMENTS

| | | | | |
|---|---|---|---|---|
| 2,553,100 A | | 5/1951 | Still | |
| 4,497,582 A | | 2/1985 | Lipman et al. | |
| 4,585,424 A | * | 4/1986 | DeMars | A63H 3/006 446/295 |
| 4,614,505 A | * | 9/1986 | Schneider | A63H 33/004 428/11 |
| 4,734,948 A | * | 4/1988 | Danova | A47G 9/0207 428/100 |
| 4,858,079 A | | 8/1989 | Ohashi | |
| 4,889,512 A | * | 12/1989 | Burnett | A63H 3/005 446/72 |
| 4,942,502 A | | 7/1990 | Ohashi | |

(Continued)

FOREIGN PATENT DOCUMENTS

| | | |
|---|---|---|
| CN | 2937806 | 8/2007 |
| CN | 202637996 | 1/2013 |

(Continued)

OTHER PUBLICATIONS

.https://www.google.com/search?q=projector+and+(stuffed+OR+bear+OR+plush+OR+doll)&biw=1280&bih=929&tbm=isch&source=lnms&sa=X&ved=0ahUKEwjolqGyxa3PAhXJ6IMKHfgZB4gQ_AUIYCgB#q=projector%20and%20(stuffed%20OR%20bear%20OR%20plush%20OR%20doll)&tbm=isch&tbs=rimg%3ACXw3iISBYcTmljjYeWX_1wu137VI_13gfLc0Qrv15ffNQIM0BTEmIzTfSpw_1SV-wkm5Up1pBsOdHyLxPHgtO8fZaaMaioSCdh5Zf_1C7XftEftQNzwqY7X7KhIJWX_1eB8tzRCsRuCpFkza70WlqEgm-XI981CUzQBE9Ni6MMN9wGSoSCVMSaXNN9KnDERmxAT783fWoKhlJ9JX7CSblSnURS7exQAcW9gAqEgmkGw50flvE8RHRHzBWKsxvLSoSCeC07x9IpoxqEXOJt_1Zq9Y_1k.

(Continued)

*Primary Examiner* — Melba Bumgarner
*Assistant Examiner* — Joseph B Baldori
(74) *Attorney, Agent, or Firm* — Stephen J. Weyer, Esq.; James R. Hayne, Esq.; Stites & Harbison, PLLC

(57) ABSTRACT

A toy projector includes a housing and a light projector adapted to project light from the housing. A sheet is associated with the housing to be disposed over the light projector to thereby diffuse light emitted from the housing and to be selectively withdrawn from being over the light projector to allow the projection of light from the housing to be unobstructed.

19 Claims, 7 Drawing Sheets

(56) References Cited

U.S. PATENT DOCUMENTS

| | | | | |
|---|---|---|---|---|
| 5,001,455 | A | 3/1991 | Starchevich | |
| 5,046,985 | A * | 9/1991 | Cearfoss | A63H 3/003 434/414 |
| 5,114,376 | A | 5/1992 | Copley et al. | |
| 5,311,226 | A | 5/1994 | Karaswa | |
| 5,324,224 | A * | 6/1994 | Anderson | A63H 33/26 362/184 |
| 5,326,300 | A * | 7/1994 | Sonders | A63H 3/005 190/1 |
| 5,328,401 | A * | 7/1994 | DeMars | A63H 3/365 446/295 |
| 5,439,407 | A * | 8/1995 | Friedel | A63H 3/006 362/806 |
| 5,888,117 | A | 3/1999 | Sutton | |
| 6,165,037 | A * | 12/2000 | Van Zant | A63H 33/22 446/219 |
| 6,511,361 | B2 | 1/2003 | Koike | |
| 6,811,279 | B2 | 11/2004 | Coleman et al. | |
| 6,894,434 | B1 * | 5/2005 | Kosoff | A61M 21/02 315/134 |
| 7,281,825 | B2 | 10/2007 | Neckels | |
| 7,438,446 | B1 | 10/2008 | McCann | |
| 7,832,917 | B2 | 11/2010 | Chien | |
| 8,002,456 | B2 | 8/2011 | Chien | |
| 8,128,274 | B2 | 3/2012 | Chien | |
| 8,152,587 | B1 | 4/2012 | Brown | |
| 8,231,246 | B2 | 7/2012 | Chien | |
| 8,231,260 | B2 | 7/2012 | Chien | |
| 8,721,160 | B2 | 5/2014 | Chien | |
| 9,097,413 | B2 | 8/2015 | Chien | |
| 9,114,326 | B2 | 8/2015 | Johnson et al. | |
| 9,157,589 | B2 | 10/2015 | Chien | |
| 2005/0197041 | A1 | 9/2005 | Fink | |
| 2006/0194508 | A1 * | 8/2006 | Johnson | A63H 3/003 446/485 |
| 2012/0088434 | A1 * | 4/2012 | Teel | A63H 3/006 446/268 |
| 2012/0142249 | A1 * | 6/2012 | Chan | A63H 3/28 446/321 |
| 2012/0188451 | A1 * | 7/2012 | Schmidt | H04N 9/3141 348/553 |
| 2012/0257418 | A1 | 10/2012 | Fields | |
| 2013/0040532 | A1 * | 2/2013 | Khubani | A63H 3/02 446/369 |
| 2013/0280985 | A1 * | 10/2013 | Klein | A63H 3/003 446/297 |
| 2014/0268882 | A1 | 9/2014 | Hoang | |
| 2014/0273716 | A1 * | 9/2014 | Annis | A63H 33/22 446/175 |
| 2014/0273731 | A1 | 9/2014 | Hockerman | |
| 2014/0335757 | A1 * | 11/2014 | Khubani | A63H 3/006 446/219 |
| 2015/0147932 | A1 * | 5/2015 | Vizcarra | G03B 21/145 446/72 |
| 2015/0276178 | A1 | 10/2015 | Chien | |
| 2016/0097500 | A1 | 4/2016 | Chien | |
| 2016/0178156 | A1 * | 6/2016 | Magras-Sinnen | F21V 17/007 362/320 |
| 2016/0209013 | A1 | 7/2016 | Chien | |

FOREIGN PATENT DOCUMENTS

| | | |
|---|---|---|
| CN | 202724675 | 2/2013 |
| CN | 202820626 | 3/2013 |
| CN | 202983186 | 6/2013 |
| JP | H-0739655 | 2/1995 |
| JP | 2005160541 | 6/2006 |

OTHER PUBLICATIONS http://www.online4baby.com/chicco-baby-bear-projector-light-blue.

https://www.solidrop.net/product/creative-glowing-luminous-led-light-projection-projector-pillow-cushion-plush-bear-toy-night-light-stars-doll-baby-children-gift.html.

https://www.walmart.com/ip/Cloud-B-Twilight-Buddies-Plush-Animal-Star-Projector-LED-Night-Light-Palomino/46697810.

http://www.walmart.ca/en/ip/cloud-b-twilight-cuddle-buddies-sheep-nightlight/6000187895708.

http://www.manfi.pl/product-pol-5133-BABY-LOVE-MIS-BRAZOWY-PROJEKTOR-SPIOSZEK-KOLYSKANKI-PL.html.

http://www.rajmalucha.pl/dla-dziewczynek/1192-interaktywny-mis-spioszek-kolysanka-projektor-lampka-8033113094408.html.

http://www.tradekorea.com/product/detail/P573870/Plush-Owl-Star-Projector-with-Lullabies-Music.html.

http://store.barnettharley.com/LK20355-Harley_Davidson_Stuffed_Starry_Night_Bear_Projector#.V-lbO9H6vcs.

http://www.diytrade.com/china/pd/11775711/Pillow_Pets_Starlight_Plush_Star_Light_Projector_NightLite.html.

http://picclick.co.uk/Pabobo-Musical-Star-Projector-Plush-Bunny-Nightlight-371729541411.html.

http://www.babycity.co.uk/fisher-price-hippo-plush-projection-soother-pd-6271.html.

* cited by examiner

COMBINATION TOY PROJECTOR AND NIGHTLIGHT

FIELD OF INVENTION

The present invention relates to a toy projector and in particular a toy projector with nightlight.

BACKGROUND OF THE INVENTION

Light projectors have been developed to project light such as on the ceiling and walls of one's home. Some devices have been developed for use in a child's room to provide visual interest and stimulation for a baby and infant.

There is a need for improved light projecting devices for babies, infants and young children.

SUMMARY OF THE INVENTION

The present invention is directed to an improved toy projector suitably adapted for use in a baby's or infant's room. The present projector has a dual function allowing the projection of light onto the wall and ceiling, as well as functioning as a nightlight. As a projector, the device can project various shapes on the wall or ceiling of a room and when acting as a nightlight the projector illuminates a surface of the device. In one advantageous form, the present device has an integrated sound machine for playing sounds including music.

The present invention in one form thereof is directed to a toy projector which has a housing and a light projector adapted to project light from the housing. A sheet is associated with the housing to be optionally disposed over the light projector thereby defusing light emitted through its housing and thus allowing the toy projector to function as a nightlight. The sheet is selectively withdrawable from being over the light projector to thereby allow the projection of light from the housing unobstructed by the sheet.

In one advantageous form, the sheet is permanently attached to the housing. For example, in one specific further embodiment, the sheet forms a pocket which is reversibly disposed over the light projector to thereby defuse the light being emitted from the housing when over the projector and the pocket being withdraw from being over the light projector to thereby allow projection of light from the housing unobstructed by the pocket. For example, in one specific form, the pocket is invertible to form a pocket over a front surface of the housing and then withdrawn and inverted to be over a rear surface of the housing.

The present toy projector in one further alternative form may have a pattern formed on the sheet such that the light projector illuminates the pattern of the sheet when disposed over the light projector. Such patterns include but are not limited to raindrops and polka dots.

The toy projector can be in the form of a plush animate structure such as a stuffed animal or alternatively, the housing of the toy projector, can be composed of a substantially rigid housing such as plastic.

In one further alternative form, the toy projector has a speaker for playing music or other sounds.

DETAILED DESCRIPTION

Figure 1:
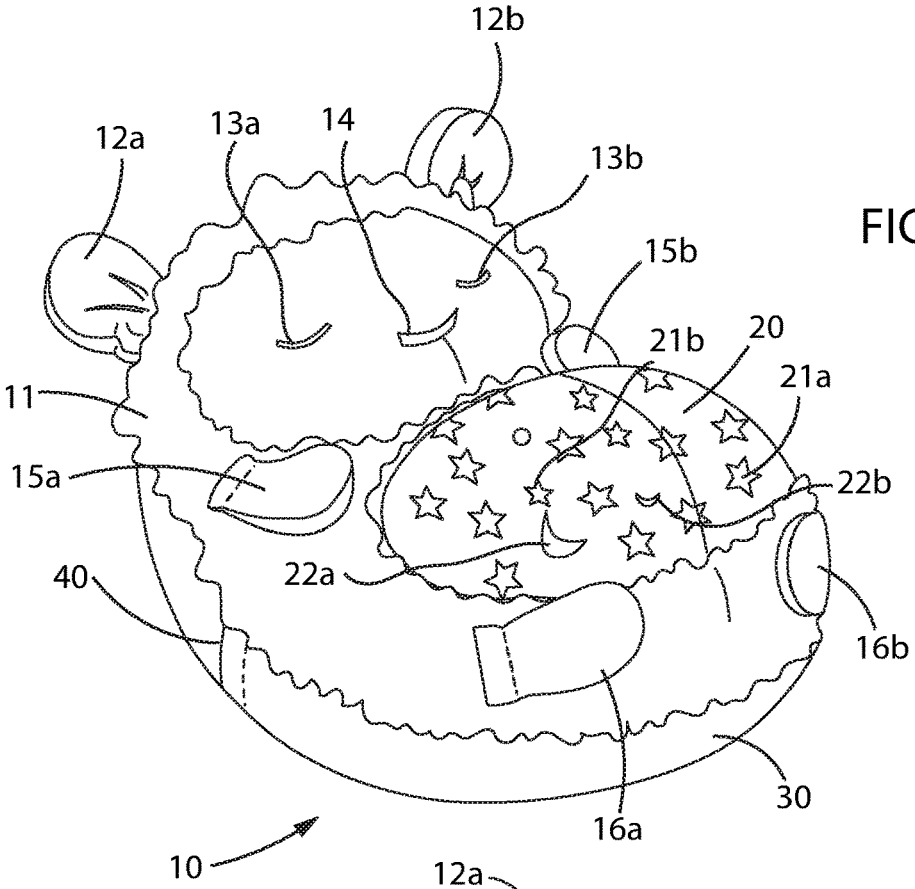
FIG. 1 is a perspective view of a toy projector in the shape of a plush lamb stuffed animal with projector uncovered in accordance with the present invention.

The present invention will now be described with reference to the Figures. FIGS. 1-6 shown a plush stuffed animal in the shape of a lamb which incorporates aspects of the present toy projector. FIGS. 7-12 are directed to a plush teddy bear stuffed animal which incorporates aspects of the present toy projector. All functional aspects of the lamb of FIGS. 1-6 and the teddy bear of FIGS. 7-12 are identical and the only difference is the physical appearance between the two as shown in the Figures. Accordingly, description of the functional aspects of the present toy projector will focus primarily on the lamb of FIGS. 1-6 of toy projector 10. Like elements in toy projector 10 are identified using similar reference numbers but raised by 100 identified in the teddy bear toy projector 110 in FIGS. 7-12.

Referring now to FIGS. 1-6 specifically, lamb toy projector 10 includes a soft plush exterior surface 11 forming its housing and enclosing stuffed material such as a polyester fill material or other suitable plush material. The toy projector 10 has two ears 12*a*, 12*b*, two eyes 13*a*, 13*b* and a nose 14. Further, the lamb toy 10 has two arms 15*a*, 15*b* and two legs 16*a*, 16*b*. Its belly 20 is advantageously composed of a rigid material such as plastic or other suitable material. The belly 20 has a series of different shapes and sizes of apertures in the form of geometric shapes such as stars 21*a*, 21*b* and moon 22*a*, 22*b*. For example, star 21*a* is a larger star relative to a smaller star 21*b*.

Disposed within the housing 11 is a light source such as a light bulb or other illuminating device which includes but is not limited to an LED which projects light from inside the housing 11 through the plurality of apertures in the belly 20 to thereby project light in the form of different shapes corresponding to stars 21*a*, 21*b* and moons 22*a*, 22*b*.

The light source is powered by a suitable power source including batteries or DC power adapter as known in the industry. The batteries may be rechargeable including via a power cord or solar.

Figure 2:
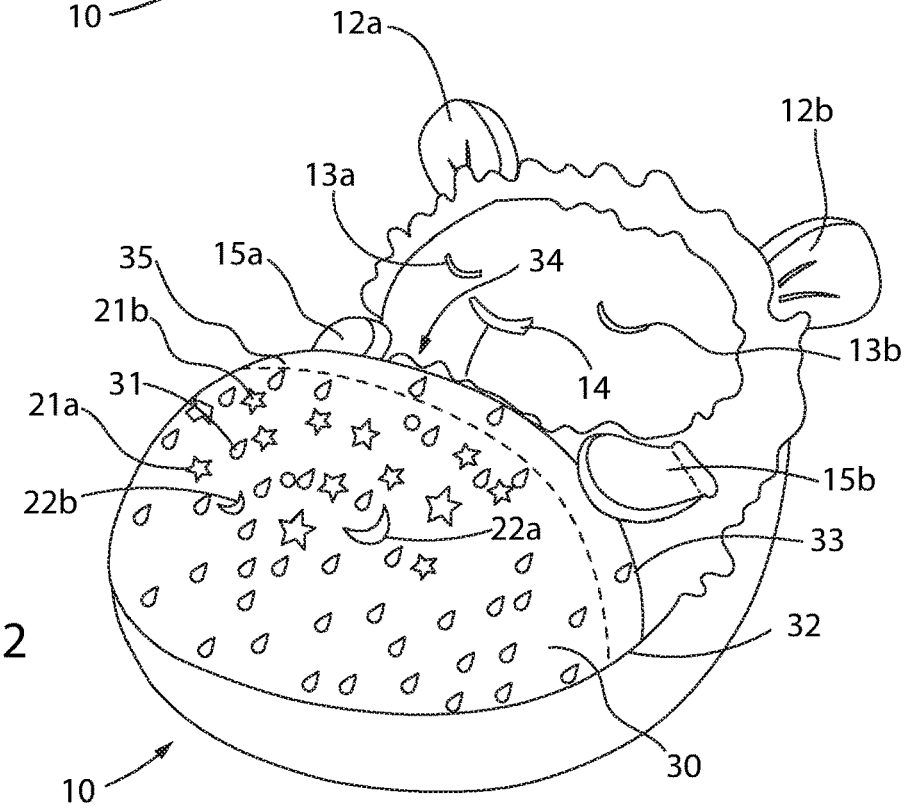
FIG. 2 the projector of FIG. 1 with a sheet over the projector in accordance with one aspect of the present invention.
Figure 4:
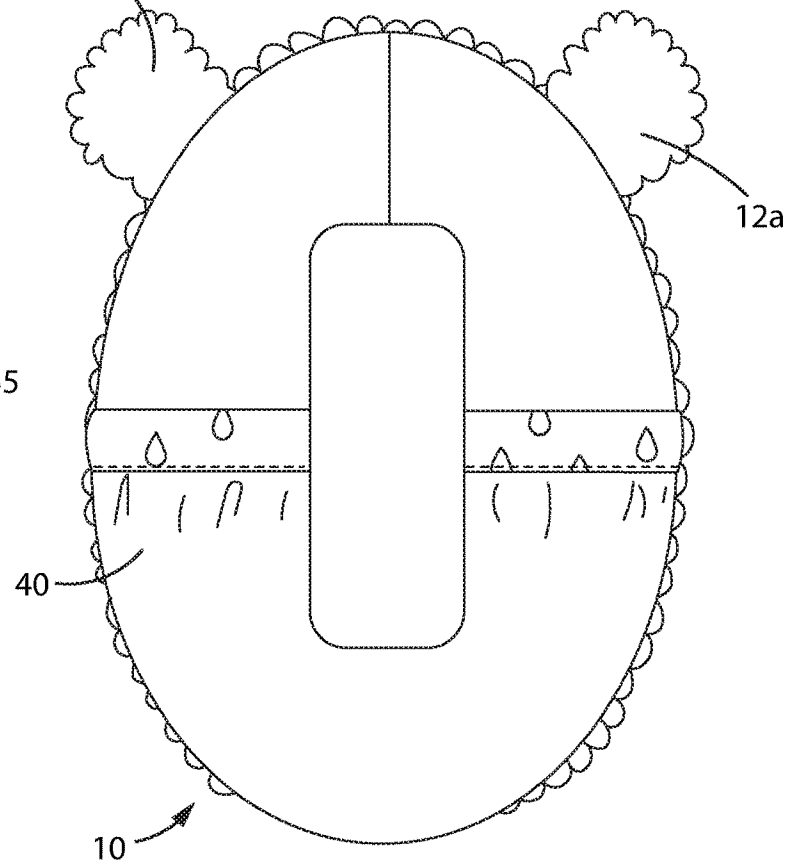
FIG. 4 is a rear elevation view of the toy projector of FIG. 2.
Figure 3:
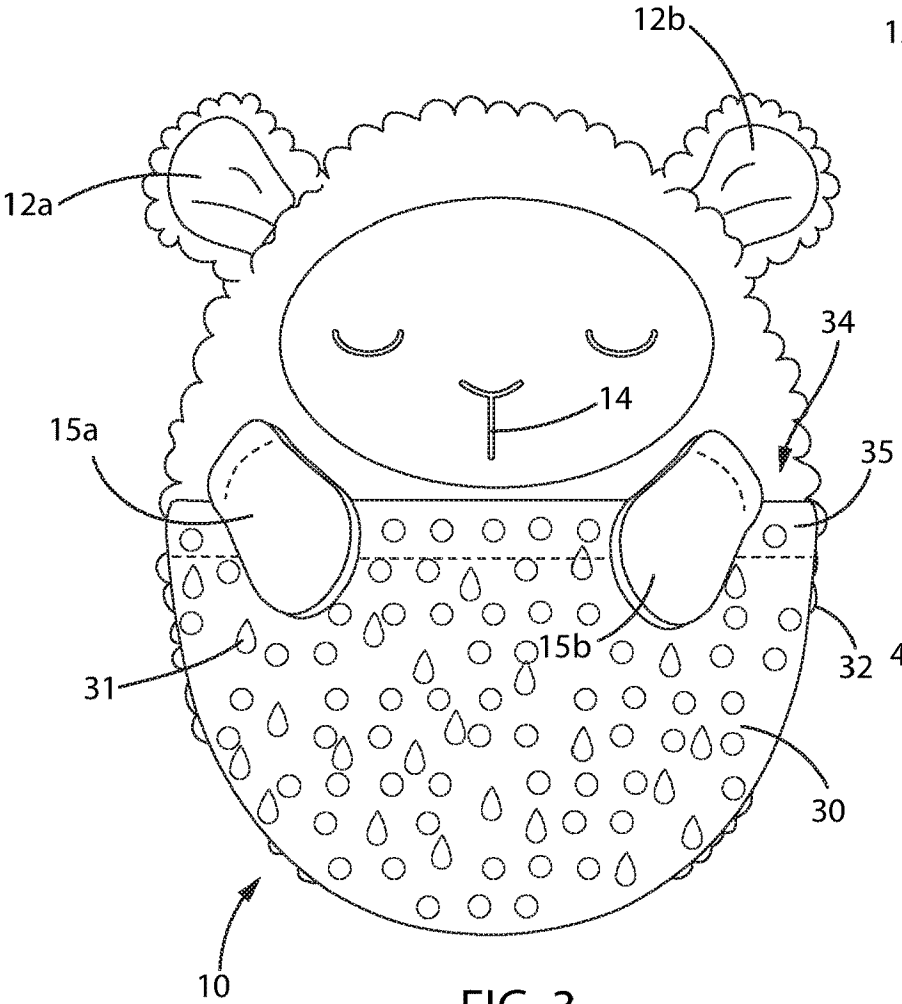
FIG. 3 is a front elevation view of the toy projector of FIG. 2.

Referring now to FIGS. 2 and 3, a sheet 30 having a raindrop pattern 31 is permanently attached the housing 11 stitched along line 32 and open at its top 33 forming a pocket 34. A strip of elastic material 35 is sewn into the top portion, proximate top 33, to cinch the opening closed. Sheet 30 is advantageously composed of a fabric material such as a cloth material or textile. However, the sheet can be composed of other materials including non-woven material.

Figure 6:
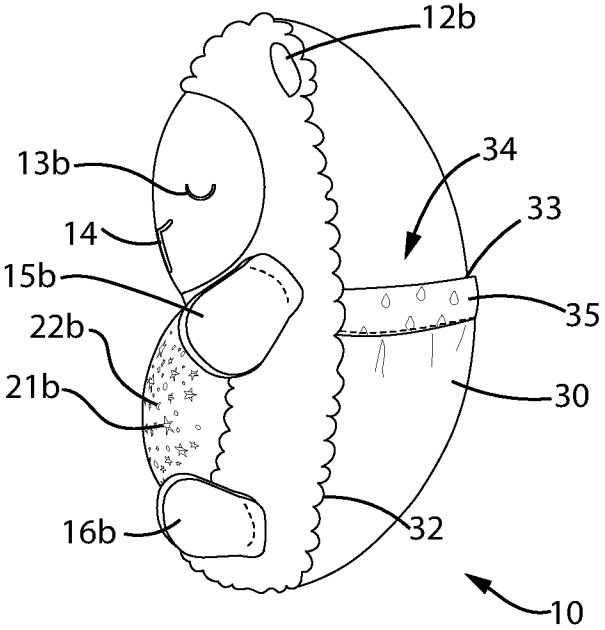
FIG. 6 is a right elevation view of the toy projector of FIG. 1.
Figure 5:
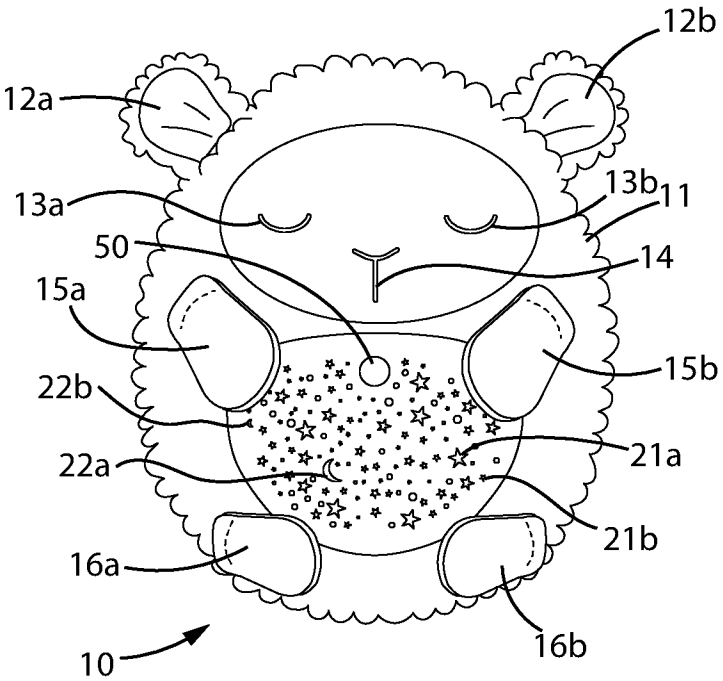
FIG. 5 is a front elevation view of the toy projector of FIG. 1.
Figures 7, 8:
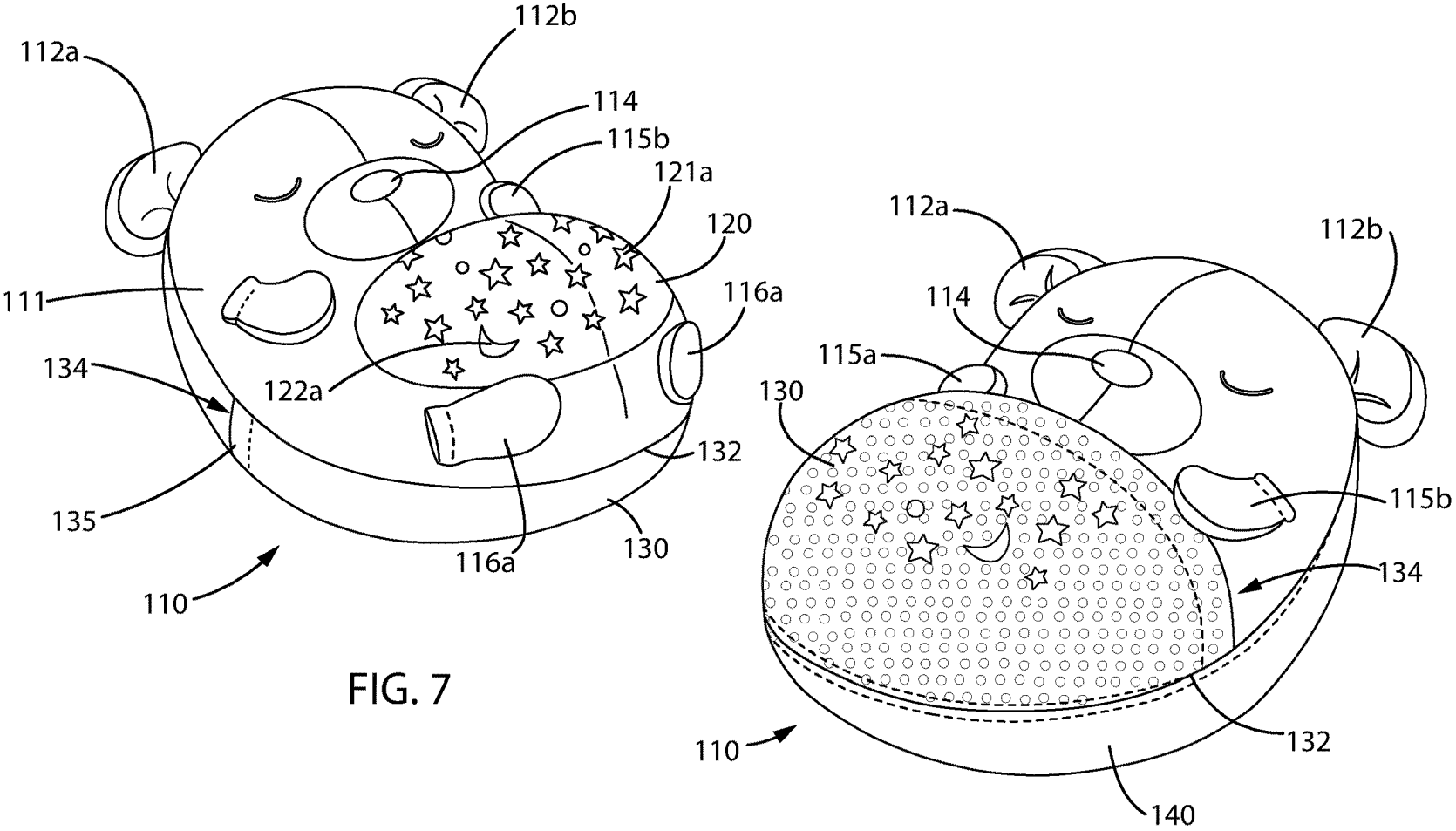
FIG. 7 is another toy projector in accordance with the present invention in the shape of a plush toy bear shown with its projector uncovered.
FIG. 8 is another perspective view of the toy projector of FIG. 7 shown with a sheet in the form of a pocket over the projector in accordance with the present invention.
Figure 10:
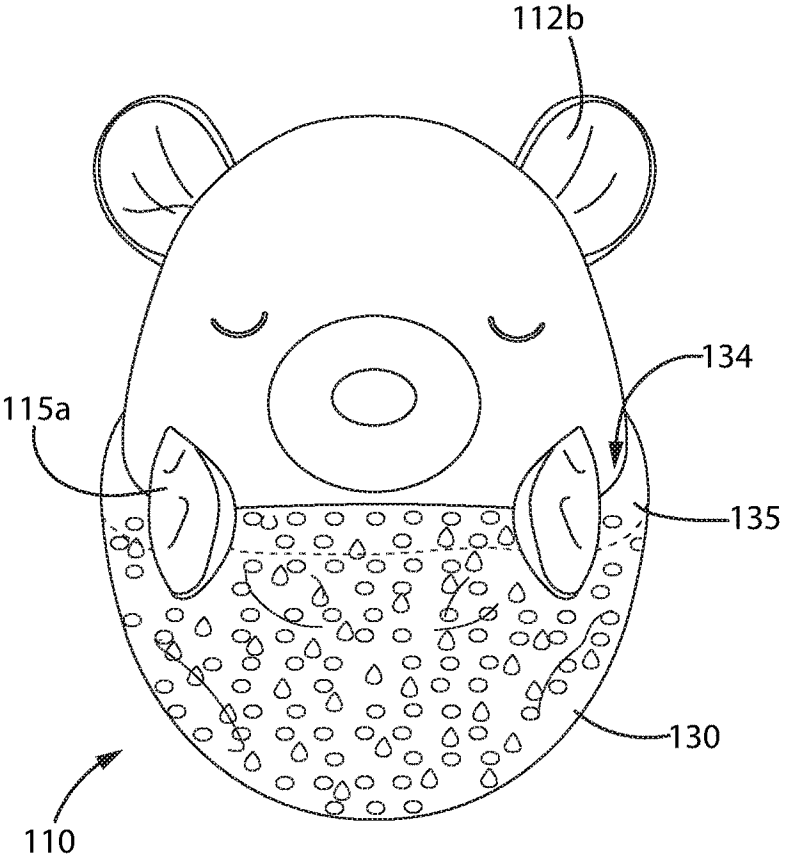
FIG. 10 is a front elevation view of the toy projector of FIG. 7 shown with a pocket over the light projector.
Figure 9:
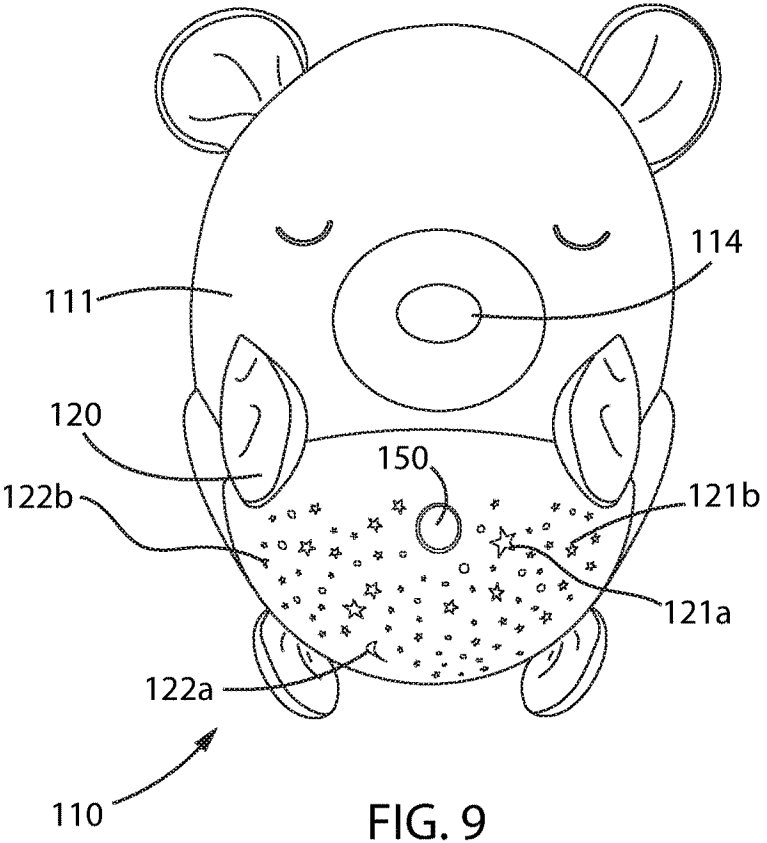
FIG. 9 is a front elevation view of the toy projector of FIG. 7.
Figure 12:
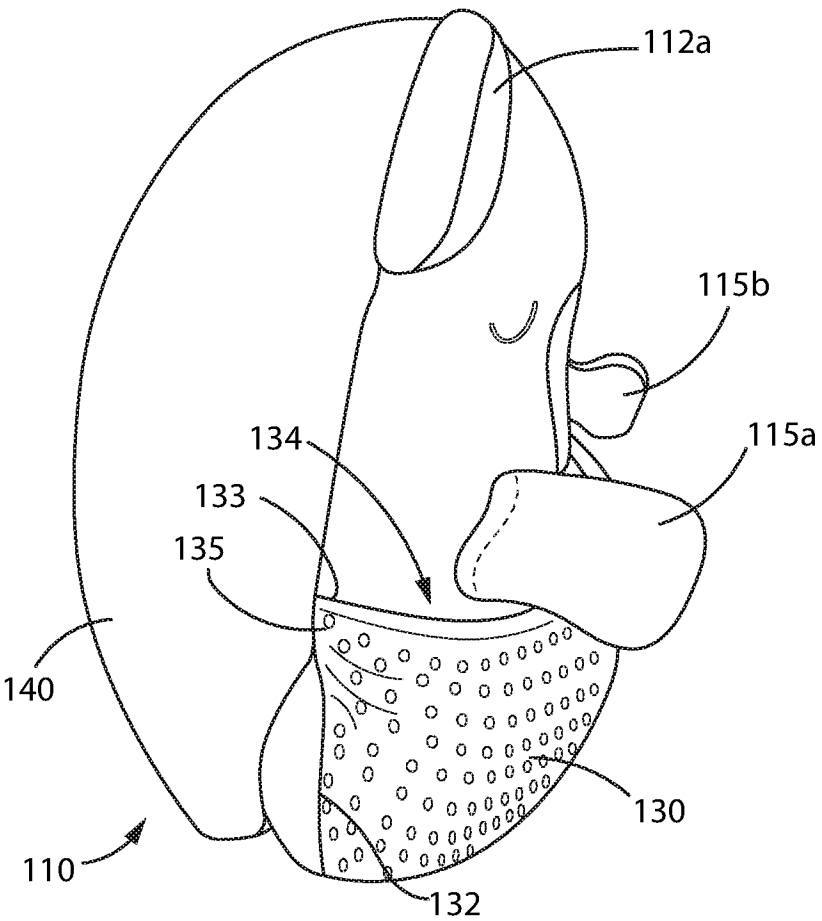
FIG. 12 is a left elevation view of the toy projector of FIG. 10.
Figure 11:
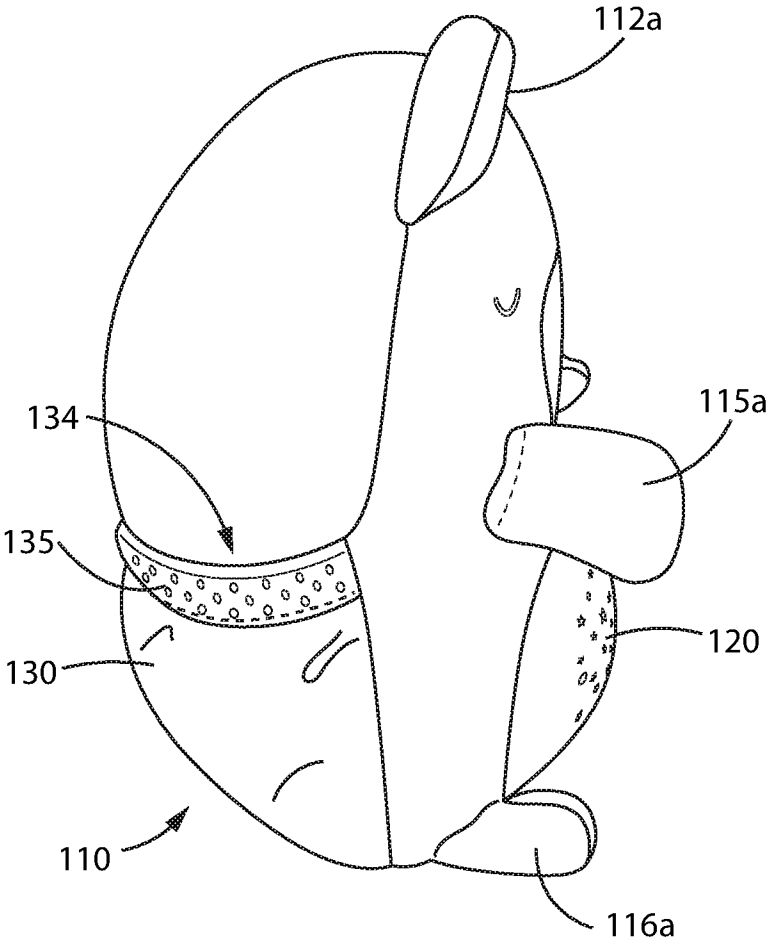
FIG. 11 is a left elevation view of the toy projector of FIG. 9.

The pocket 34 is reversibly/invertibly disposed over the belly 20 as shown in FIGS. 2 and 3 and can be pulled back away from the belly 20 and disposed over the back 40 (FIG. 4*a*) or rear surface of the lamb toy projector as shown in FIGS. 1, 5 and 6. When the sheet 30 is pulled over the belly 20 as shown in FIGS. 2 and 3, light emitted from the light source is diffused thereby illuminating the sheet 30 allowing the toy projector 10 to act as a nightlight with its abdomen being illuminated through the sheet 30. As a result, a combination of the pattern 31 on the sheet 30 as well as the shapes of the stars 21*a*, 21*b* and moons 22*a*, 22*b* produce an illuminated pattern visible on sheet 30 shown in FIG. 2.

In one alternative embodiment, instead of the belly 20 being composed of a rigid material with a plurality of apertures therethrough and a light source disposed within the housing 11, the projector may be in the form of a filter or lens in front of a light source disposed within the housing, in which the filter has geometric shapes. The belly can be in the form of a substantially transparent material through which the light source projects geometric shapes images through the substantially transparent belly.

A speaker along with a processor and memory allow sounds and/or music to be played from the toy projector 10. Advantageously, toggle button 50 (FIG. 5) activates/deactivates the toy projector to illuminate and play music simultaneously.

In yet a further alternative form, rather than a plush toy such as lamb 10 and teddy bear 110, the housing 11, 111 can be a substantially rigid material such as being composed of plastic or other suitable material.

Figure 14:
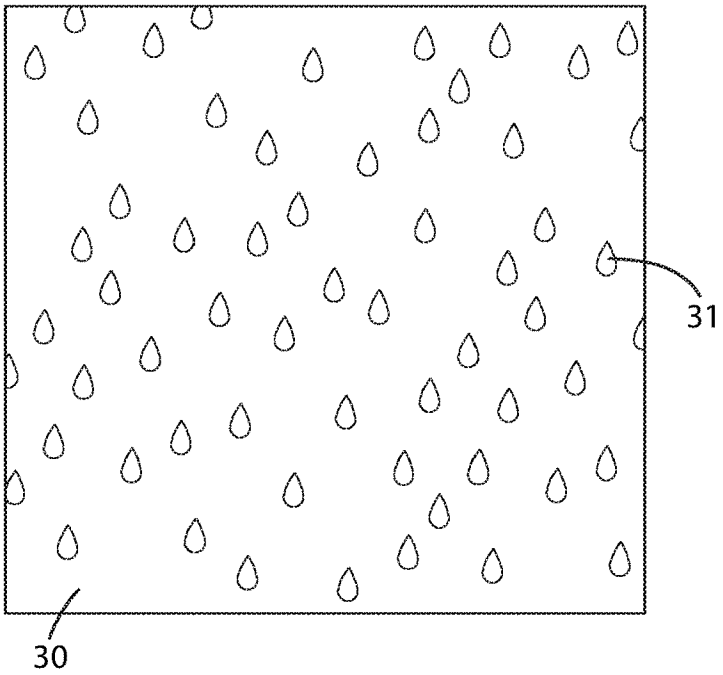
FIG. 14 is plain view of another sheet pattern in accordance with another aspect of the present invention.
Figure 13:
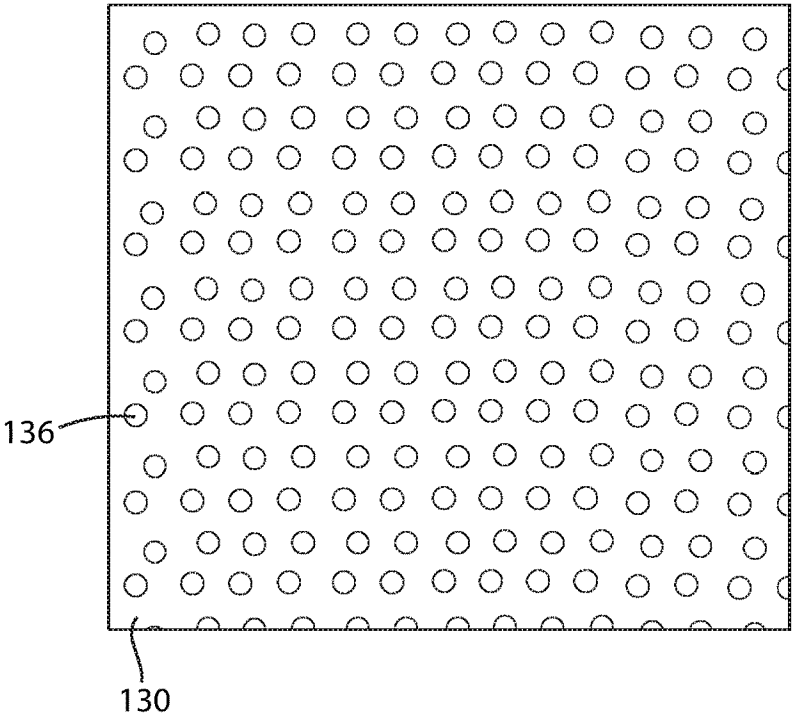
FIG. 13 is a plan view of a polka dot pattern of a sheet in accordance with the present invention.

Referring now to FIGS. 13 and 14, the sheet 30, 130 can have different patterns to provide interest. FIG. 13 shows a polka dot pattern 36 having a wavy pattern and FIG. 14 shows a raindrop pattern 31 having a different shapes of raindrops irregularly placed over its surface. FIGS. 13 and 14 are illustrative of only two possible patterns for the sheet 30, 130. It will be appreciated that sheet 30 can be any color, and optionally have any pattern or no pattern at all as desired.

It will now be clear to one of ordinary skill in the art that the present toy projector has features and advantages not found in prior devices. The present toy projector both projects images on a wall and ceiling as well as being transformable into a night light using a reversible pocket integrally formed with the toy projector.

One of ordinary skill in the art will recognize that additional embodiments are also possible without departing from the teachings of the presently-disclosed subject matter. This detailed description, and particularly the specific details of the exemplary embodiments disclosed herein, is given primarily for clarity of understanding, and no unnecessary limitations are to be understood therefrom, for modifications will become apparent to those skilled in the art upon reading this disclosure and can be made without departing from the spirit and scope of the presently-disclosed subject matter.

The invention claimed is:

1. A toy projector comprising:

a housing comprising a screen having a plurality of apertures of different shapes;

a light source enclosed within the housing, the light source adapted to project light from the housing through the apertures in the screen; and a sheet composed of a translucent material, the sheet sealed to the housing along an entire perimeter of the sheet except for its top side thereby forming a reversible pocket affixed to the housing and open at its top, the pocket having a first configuration in which the sheet is disposed over a rear surface of the housing opposite from the screen, such that the light projected from the housing through the apertures in the screen projects the different shapes onto a wall or a ceiling, the pocket having a second configuration in which the sheet is disposed over the screen and the light projected from the housing through the apertures in the screen is diffused through the sheet such that an area of the sheet is illuminated with the different shapes visible on the sheet while the different shapes are obstructed from being projected onto the wall or the ceiling.

2. The toy projector of claim 1, wherein the sheet has a strip of elastic material proximate the segment of the perimeter of the sheet that is not permanently attached to the housing.

3. The toy projector of claim 1, wherein the housing comprises a plush animate structure.

4. The toy projector of claim 3, wherein the plush animate structure comprises plush stuffed animal having a body and facial features.

5. The toy projector of claim 4, wherein the plush animate structure further comprises a nose or muzzle, arms, legs, and a belly.

6. The toy projector of claim 1, wherein the screen is composed of a substantially rigid material.

7. The toy projector of claim 1, further comprising a speaker for playing music.

8. The toy projector of claim 7, further comprising a processor and memory for music to be played through the speaker.

9. The toy projector of claim 1, wherein the different shapes are celestial shapes.

10. A toy projector comprising:

a housing comprising a screen having a plurality of apertures of different shapes;

a light source enclosed within the housing, the light source adapted to project light from the housing through the apertures in the screen; and a sheet composed of a translucent material and having a pattern formed thereon, the sheet sealed to the housing along an entire perimeter of the sheet except for its top side thereby forming a reversible pocket affixed to the housing and open at its top, the pocket having a first configuration in which the sheet is disposed over a rear surface of the housing opposite from the screen, such that the light projected from the housing through the apertures in the screen projects the different shapes onto a wall or a ceiling, the pocket having a second configuration in which the sheet is disposed over the screen and the light projected from the housing through the apertures in the screen is diffused through the sheet such that an area of the sheet is illuminated with the pattern of the sheet and the different shapes visible on the sheet while the different shapes are obstructed from being projected onto the wall or the ceiling.

11. The toy projector of claim 10, wherein the sheet has a strip of elastic material proximate the segment of the perimeter of the sheet that is not permanently attached to the housing.

12. The toy projector of claim 10, wherein the pattern is selected from the group consisting of rain drops and polka dots.

13. The toy projector of claim 10, wherein the housing comprises a plush animate structure.

14. The toy projector of claim 13, wherein the plush animate structure comprises plush stuffed animal having a body and facial features.

15. The toy projector of claim 14, wherein the plush animate structure further comprises a nose or muzzle, arms, legs, and a belly.

16. The toy projector of claim 10, wherein the screen is composed of a substantially rigid material.

17. The toy projector of claim 10, further comprising a speaker for playing music.

18. The toy projector of claim 17, further comprising a processor and memory for music to be played through the speaker.

19. The toy projector of claim 10, wherein the different shapes are celestial shapes.

* * * * *